US009995504B2

(12) United States Patent
Kono et al.

(10) Patent No.: US 9,995,504 B2
(45) Date of Patent: Jun. 12, 2018

(54) AIR CONDITIONER HAVING AIR OUTLET LOUVER WITH VARYING CURVATURE

(71) Applicant: Mitsubishi Electric Corporation, Tokyo (JP)

(72) Inventors: Atsushi Kono, Tokyo (JP); Takashi Ikeda, Tokyo (JP); Masahiko Takagi, Tokyo (JP); Makoto Kurihara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 263 days.

(21) Appl. No.: 14/430,232

(22) PCT Filed: Oct. 23, 2013

(86) PCT No.: PCT/JP2013/078689
§ 371 (c)(1),
(2) Date: Mar. 23, 2015

(87) PCT Pub. No.: WO2014/069301
PCT Pub. Date: May 8, 2014

(65) Prior Publication Data

US 2015/0253032 A1 Sep. 10, 2015

(30) Foreign Application Priority Data

Oct. 30, 2012 (WO) ..... PCT/JP2012/077979

(51) Int. Cl.
*F28F 1/00* (2006.01)
*F24F 13/08* (2006.01)
(Continued)

(52) U.S. Cl.
CPC ..... *F24F 13/08* (2013.01); *F24F 1/0011* (2013.01); *F24F 5/0007* (2013.01); *F24F 13/14* (2013.01); *F24F 2001/0037* (2013.01)

(58) Field of Classification Search
CPC ..... F24F 13/08; F24F 13/14; F24F 1/0011; F24F 5/0007; F24F 13/081; F24F 13/10;
(Continued)

(56) References Cited

U.S. PATENT DOCUMENTS 2,123,287 A * 7/1938 Ney ..... F24F 13/08 454/216
5,722,484 A * 3/1998 Subramanian ..... F24F 1/0011 165/122
(Continued)

FOREIGN PATENT DOCUMENTS

EP 0 950 867 A2 10/1999
EP 1 471 311 A1 10/2004
(Continued)

OTHER PUBLICATIONS

European Extended Search Report dated Jun. 24, 2016 in the corresponding EP application No. 138512215.
(Continued)

*Primary Examiner* — Jianying Atkisson
*Assistant Examiner* — Jose O Class-Quinones
(74) *Attorney, Agent, or Firm* — Posz Law Group, PLC

(57) ABSTRACT

An air conditioner includes: a heat exchanger housed inside a main body and arranged in a flow passage of air to be sucked into the main body through an air inlet and blown out to a target space through an air outlet; and an airflow-direction vane arranged at the air outlet. The airflow-direction vane includes a first curved portion and a second curved portion. The first curved portion is positioned on an upstream side with respect to the second curved portion, and a curvature of the first curved portion is larger than a curvature of the second curved portion.

2 Claims, 7 Drawing Sheets

(51) Int. Cl.
*F24F 13/14* (2006.01)
*F24F 1/00* (2011.01)
*F24F 5/00* (2006.01)

(58) Field of Classification Search
CPC ..... F24F 1/0022; F24F 1/0007; F24F 2001/0037; F24F 1/0003; F24F 1/0014; F24F 2001/0048; F24F 1/02; F24F 1/027; F24F 13/06; F04D 29/44; F04D 29/444; F04D 29/53; F04D 29/542; F04D 29/544; F25D 17/06
USPC ..... 165/177; 416/185, 186, 186 A, 187
See application file for complete search history.

(56) References Cited

U.S. PATENT DOCUMENTS

| | | | | |
|---|---|---|---|---|
| 6,145,335 | A * | 11/2000 | Nagaoka | F24F 1/0011 454/233 |
| 6,217,285 | B1 * | 4/2001 | Kurokawa | F04D 29/282 416/186 R |
| 2007/0119966 | A1 * | 5/2007 | Dry | C21C 5/4606 239/88 |

FOREIGN PATENT DOCUMENTS

| | | | | | |
|---|---|---|---|---|---|
| EP | 1 589 292 | A1 | | 10/2005 | |
| EP | 2 216 608 | A1 | | 8/2010 | |
| EP | 2 295 878 | A2 | | 3/2011 | |
| JP | 3392644 | B2 | | 1/1998 | |
| JP | H11-118233 | A | | 4/1999 | |
| JP | H11-248188 | A | | 9/1999 | |
| JP | 2000-065418 | A | | 3/2000 | |
| JP | 2003-294303 | A | | 10/2003 | |
| JP | 2003-329295 | A | | 11/2003 | |
| JP | 2003329295 | A | * | 11/2003 | |
| JP | 2007-024345 | A | | 2/2007 | |
| JP | 2007024345 | A | * | 2/2007 | |
| JP | 2010-032132 | A | | 2/2010 | |
| WO | WO 0135031 | A1 | * | 5/2001 | F24F 1/0011 |
| WO | 2011040519 | A1 | | 4/2011 | |

OTHER PUBLICATIONS

International Search Report of the International Searching Authority dated Jan. 14, 2014 for the corresponding international application No. PCT/JP2013/078689 (and English translation).

* cited by examiner

AIR CONDITIONER HAVING AIR OUTLET LOUVER WITH VARYING CURVATURE

CROSS REFERENCE TO RELATED APPLICATION

This application is a U.S. national stage application of PCT/JP2013/078689 filed on Oct. 23, 2013, which claims priority to International application No. PCT/JP2012/077979, filed on Oct. 30, 2012, the contents of which are incorporated herein by reference.

TECHNICAL FIELD

The present invention relates to an air conditioner.

BACKGROUND ART

As a ceiling-concealed air conditioner of the related art, for example, an air conditioner disclosed in Patent Literature 1 is known. In this air conditioner, a bent portion is formed in an airflow-direction vane of each air outlet of a main body. The bent portion is positioned in an upstream-side part of the airflow-direction vane, and is bent in a direction to separate from an air duct wall positioned on a main-body center side of each air outlet. When such a bent portion is formed, an air duct area on the main-body center side (inner side) of the airflow-direction vane can be secured. Therefore, the air velocity does not decrease in this part, and intake of the air from the inside of the room is suppressed. Therefore, it is possible to expect prevention of dew condensation at the air outlet, which may be caused by mixture of high-temperature air inside the room and low-temperature air to be blown out during a cooling operation.

CITATION LIST

Patent Literature

[PTL 1] JP 2007-24345 A (page 6 and FIG. 2)

SUMMARY OF INVENTION

Technical Problem

However, in the above-mentioned air conditioner disclosed in Patent Literature 1, the airflow rate of air flowing on the inner side of the airflow-direction vane can be increased, but in such a mode that the blowing-out direction of the airflow-direction vane is set closer to the horizontal direction, separation of an air current may occur.

The present invention has been made in order to solve the above-mentioned problem, and has an object to provide an air conditioner capable of preventing dew condensation to be caused by intake of the air from the inside of the room in the vicinity of the air outlet, and also capable of preventing separation of the air current at the airflow-direction vane.

Solution to Problem

In order to achieve the above-mentioned object, according to one embodiment of the present invention, there is provided an air conditioner, including: a heat exchanger housed inside a main body and arranged in a flow passage of air to be sucked into the main body through an air inlet and blown out to a target space through an air outlet; and an airflow-direction vane arranged at the air outlet. The airflow-direction vane includes a first curved portion and a second curved portion. The first curved portion is positioned on an upstream side with respect to the second curved portion, and a curvature of the first curved portion is larger than a curvature of the second curved portion.

A boundary portion between the first curved portion and the second curved portion may match with a closest portion, which is the closest part to an inner air duct wall of the air outlet on the airflow-direction vane in a horizontal blowing state, or may be positioned on a downstream side with respect to the closest portion.

The first curved portion and the second curved portion may be smoothly connected to each other.

An upstream end of the airflow-direction vane may be formed into a round shape, and the airflow-direction vane may have a maximum thickness at the upstream end.

The airflow-direction vane may have a minimum thickness at a downstream end.

The airflow-direction vane may further include a flat plate portion, and the flat plate portion may be positioned on an upstream side with respect to the first curved portion.

The airflow-direction vane may be configured so as to have an outflow angle of from 20° to 40° and an inflow angle of from 10° to 25°.

An inner air duct, which is formed by the inner air duct wall of the air outlet and the airflow-direction vane arranged at the outflow angle of from 20° to 40°, and an outer air duct, which is formed by an outer air duct wall of the air outlet and the airflow-direction vane, may be both formed into a narrowed shape.

The boundary portion between the first curved portion and the second curved portion in the airflow-direction vane may change a position thereof with respect to a downstream end and an upstream end across a longitudinal direction.

Advantageous Effects of Invention

According to the one embodiment of the present invention, it is possible to prevent dew condensation to be caused by intake of the air from the inside of the room in the vicinity of the air outlet, and also prevent the separation of the air current at the airflow-direction vane.

DESCRIPTION OF EMBODIMENTS

Figure 1:
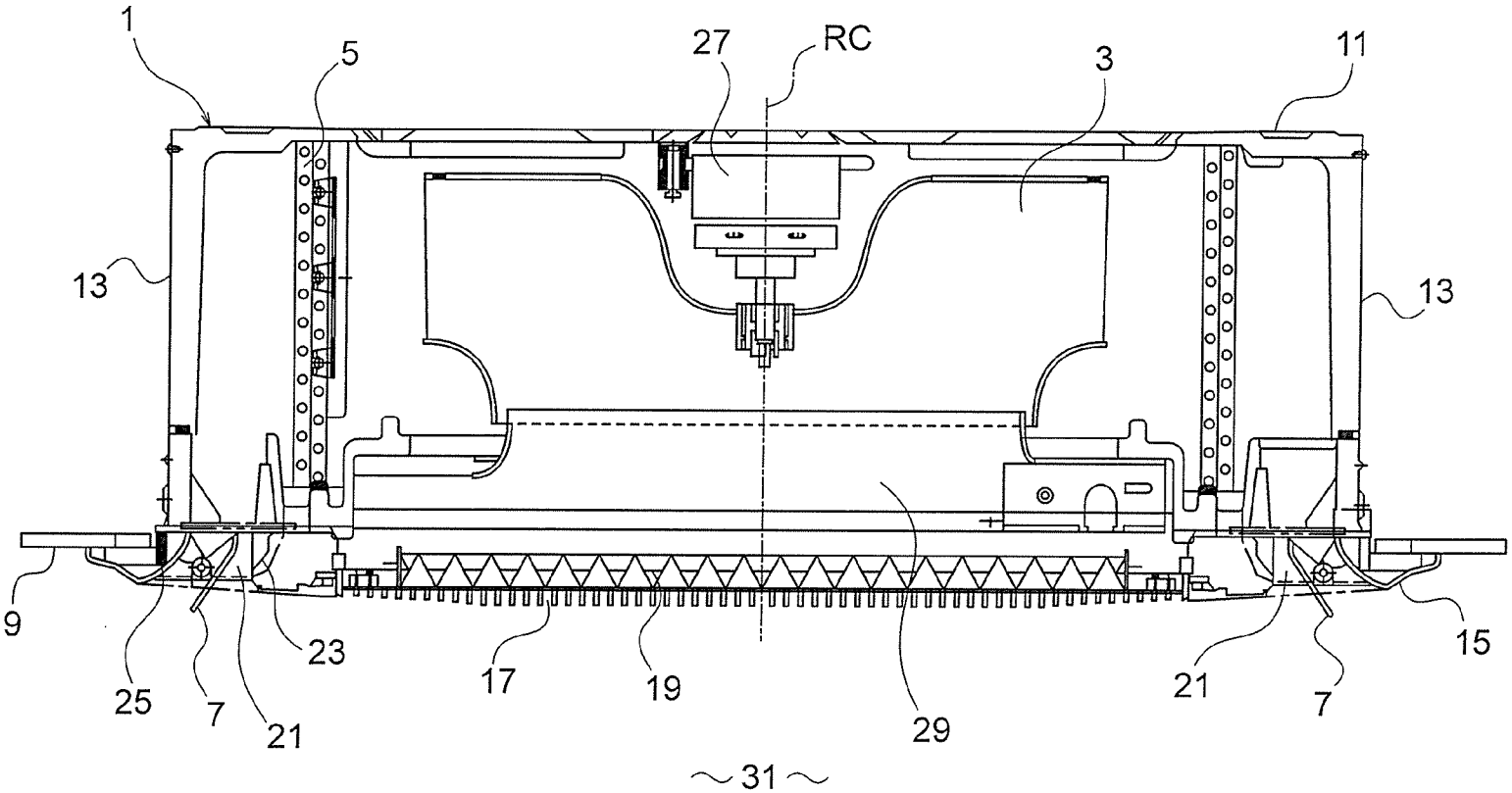
FIG. 1 is a schematic side view illustrating an internal structure of an air conditioner according to a first embodiment of the present invention.

Now, an air conditioner according to embodiments of the present invention is described with reference to the accompanying drawings. Note that, in the drawings, the same reference symbols represent the same or corresponding parts.

First Embodiment

FIG. 1 is a schematic side view illustrating an internal structure of an air conditioner according to a first embodiment of the present invention. More specifically, the air conditioner according to the first embodiment corresponds to an indoor unit of a so-called package air conditioner. FIG. 1 illustrates a state in which a principal part of a main body of the air conditioner is embedded in a ceiling of a room and a lower part of the main body faces the inside of the room.

The ceiling-concealed air conditioner includes a main body 1, a turbofan 3, a heat exchanger 5, and at least one airflow-direction vane 7. The main body 1 is embedded at a back side of a ceiling surface 9 of the room (opposite side to the room) being a target space.

As one example, in the first embodiment, the main body 1 includes a main-body top panel 11 having a rectangular shape in plan view, and four main-body side panels 13 extending downward from four sides of the main-body top panel 11. In other words, the main body 1 is such a casing that an upper end surface of a rectangular tube body defined by the four main-body side panels 13 is closed by the main-body top panel 11.

At the lower part of the main body 1, namely, at an opened lower end surface of the above-mentioned casing, a decorative panel 15 is mounted on the main body 1 in a freely removable manner. As illustrated in FIG. 1, the main-body top panel 11 is positioned above the ceiling surface 9, whereas the decorative panel 15 is positioned substantially flush with the ceiling surface 9.

In the vicinity of a center of the decorative panel 15, a suction grille 17 is formed as the inlet of air into the main body 1. A filter 19 for removing dust in the air passing through the suction grille 17 is arranged in the suction grille 17.

As one example, in the first embodiment, the decorative panel 15 and the suction grille 17 each have a rectangular outer edge in plan view.

In a region between the outer edge of the decorative panel 15 and the outer edge of the suction grille 17, a plurality of panel air outlets 21 are formed as the outlets of the air. In the first embodiment, four panel air outlets 21 are formed in accordance with the structure in which the decorative panel 15 and the suction grille 17 each have the outer edge along four sides thereof, and the respective panel air outlets 21 are arranged so as to extend along the corresponding sides of the decorative panel 15 and the suction grille 17. Further, the four panel air outlets 21 are positioned so as to surround the suction grille 17.

The main body 1 center side (rotational axis RC side to be described later) of each of the panel air outlets 21 is defined by an inner air duct wall 23, and the decorative panel 15 outer edge side of each of the panel air outlets 21 is defined by an outer air duct wall 25. On each of the panel air outlets 21, the airflow-direction vane 7 for adjusting the direction of air to be blown out is mounted.

A fan motor 27 is arranged at a center portion of the inside of the main body 1. The fan motor 27 is supported by a lower surface of the main-body top panel 11 (at an inner space side of the main body 1). A turbofan 3 is fixed to a rotational shaft of the fan motor 27, which extends downward. Further, a bellmouth 29 that defines a suction air duct extending from the suction grille 17 toward the turbofan 3 is arranged between the turbofan 3 and the suction grille 17. The turbofan 3 sucks the air into the main body 1 through the suction grille 17, and causes the air to flow out to an inside 31 of the room being the target space through the panel air outlet 21.

The heat exchanger 5 is arranged at a radially outer side of the turbofan 3. In other words, the heat exchanger 5 is arranged in a flow passage of the air to be generated inside the main body 1 by the turbofan 3, to thereby exchange heat between the air and a refrigerant.

The heat exchanger 5 includes a plurality of fins arranged at predetermined intervals in a horizontal direction, and heat transfer pipes passing through the fins. The heat transfer pipes are connected to a known outdoor unit (not shown) through a connection pipe so that a cooled or heated refrigerant is supplied to the heat exchanger 5. Note that, the structures and modes of the turbofan 3, the bellmouth 29, and the heat exchanger 5 are not particularly limited, but known structures and modes are employed in the first embodiment.

In this structure, when the turbofan 3 is rotated, the air in the inside 31 of the room is sucked into the suction grille 17 of the decorative panel 15. Then, the air from which the dust is removed by the filter 19 is guided by the bellmouth 29 that defines the air inlet of the main body, and is then sucked into the turbofan 3. Further, the air sucked into the turbofan 3 from bottom to top is blown out in a horizontal and radially outward direction. When the air thus blown out passes through the heat exchanger 3, the heat is exchanged and/or the humidity is adjusted. After that, the air is blown out to the inside 31 of the room through each panel air outlet 21 with the flow direction switched to a downward direction. At this time, in each of the panel air outlets 9, an outflow angle of an air current to be described later is controlled by the airflow-direction vane 7.

Figure 2:
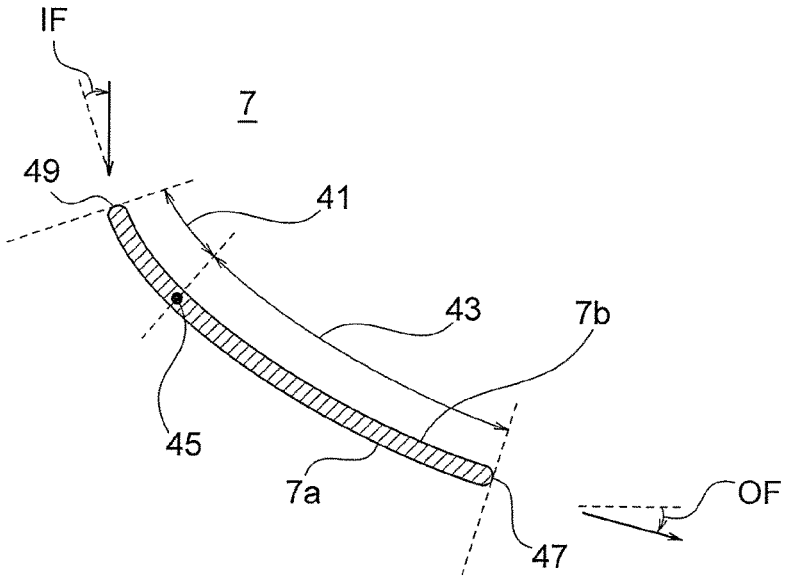
FIG. 2 is a sectional view perpendicular to a longitudinal direction of an airflow-direction vane according to the first embodiment.
Figure 3:
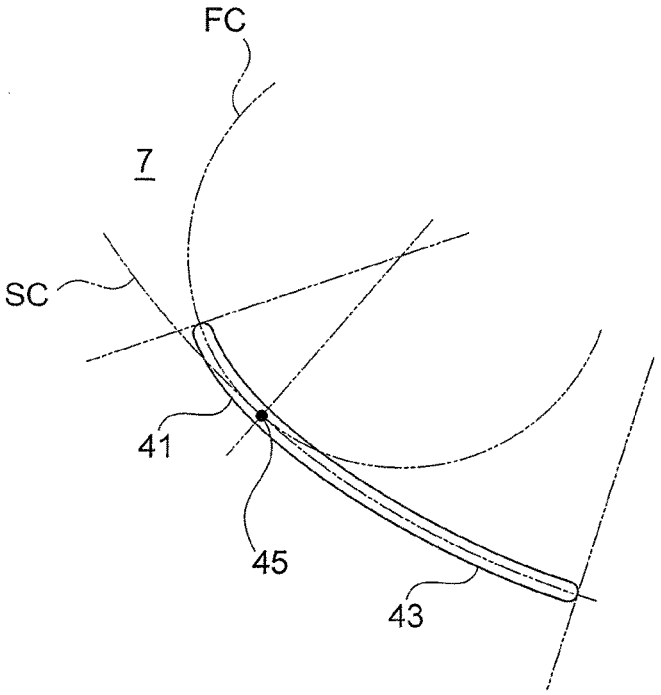
FIG. 3 is a view illustrating a curved mode of the airflow-direction vane according to the first embodiment.

Next, details of the airflow-direction vane are described also with reference to FIGS. 2 and 3. FIG. 2 is a sectional view perpendicular to a longitudinal direction of the airflow-direction vane according to the first embodiment, and FIG. 3 is a view illustrating a curved mode of the airflow-direction vane according to the first embodiment.

The airflow-direction vane 7 has a plate shape, and both of the front surface and the back surface thereof are curved. As illustrated in FIG. 2, the front surface side of the airflow-direction vane 7 forms a convex surface 7*a*, and the back surface side of the airflow-direction vane 7 forms a concave surface 7*b*. Further, regarding the relationship of the convexoconcave shape of the airflow-direction vane 7 and the panel air outlet 21, the airflow-direction vane 7 is arranged in a direction that the convex surface 7*a* is opposed to the inner air duct wall 23, and the concave surface 7*b* is opposed to the outer air duct wall 25.

Further, the airflow-direction vane 7 includes a first curved portion 41 and a second curved portion 43. As one example, in the first embodiment, the airflow-direction vane 7 is formed of only the first curved portion 41 and the second curved portion 43. The first curved portion 41 in the airflow-direction vane 7 is positioned on the upstream side with respect to the second curved portion 43. Further, the curvature of the first curved portion 41 is set larger than the curvature of the second curved portion 43. That is, when viewed in the cross section of FIGS. 2 and 3, the first curved portion 41 is curved into an arc shape along a first circle FC. When viewed in the same cross section, the second curved portion 43 is curved into an arc shape along a second circle SC. Further, the radius (curvature radius) of the first circle FC is set smaller than the radius (curvature radius) of the second circle SC.

Further, at a boundary portion 45 between the first curved portion 41 and the second curved portion 43 of the airflow-direction vane 7, the front and back surfaces of the first curved portion 41 and the front and back surfaces of the second curved portion 43 are smoothly connected to each other. In other words, as illustrated in FIG. 3, the first circle FC and the second circle SC are brought into contact with each other at the boundary portion (inflection point portion) 45. Further, as one example, in the first embodiment, the boundary portion 45 is set to a position closer to an upstream end 49 than a downstream end 47 in the airflow-direction vane 7.

Note that, an inflow angle IF of an air current in the vicinity of the upstream end 49 of the airflow-direction vane 7 represents an angle formed by an inflow air current with respect to a tangential direction of the first circle FC at the upstream end 49. An outflow angle OF of an outflow air current in the vicinity of the downstream end 47 of the airflow-direction vane 7 represents an angle formed by an outflow air current with respect to the horizontal direction. When viewed in FIG. 2, the inflow angle IF is an angle having a positive value in a clockwise manner from the tangent of the first circle FC at the upstream end 49, and, when viewed in FIG. 2, the outflow angle OF is an angle having a positive value in a clockwise manner from the horizontal direction (the same applies also to both of the inflow angle IF and the outflow angle OF in FIG. 6 to be described later). Further, such a blowing-out mode that the outflow angle OF is in a range of from 50° to 70° is referred to as "downward blowing", and such a blowing-out mode that the outflow angle OF is in a range of from 20° to 40° is referred to as "horizontal blowing".

In the air conditioner according to the first embodiment configured as described above, first, the upstream part of the airflow-direction vane 7 includes the first curved portion 41 in which the upstream end 49 is curved in a direction to separate from the inner air duct wall 23. Therefore, the airflow rate of air flowing on the inner side of the airflow-direction vane 7 can be increased, and thus, for example, it is possible to prevent dew condensation to be caused by intake of the air from the inside of the room during a cooling operation. In addition, the airflow-direction vane 7 includes the first curved portion 41 and the second curved portion 43, and the first curved portion 41 is larger than the curvature of the second curved portion 43. Therefore, even when the airflow-direction vane 7 is placed at a horizontal blowing angle, the inflow angle IF of the air current with respect to the airflow-direction vane 7 can be extremely small, and hence it is possible to prevent separation of the air current, which has occurred on the convex surface side of the airflow-direction vane in the related art. As described above, according to the first embodiment, dew condensation to be caused by intake of the air from the inside of the room is prevented, and further the pressure loss due to the separation of the air current is reduced, thereby enabling improvement in energy-saving performance and reduction in air blowing noise. Further, in the first embodiment, the first curved portion 41 and the second curved portion 43 are smoothly connected to each other. Therefore, it is possible to avoid pressure loss due to the separation of the air current or pressure loss due to the rapid change of the flow, which may be caused by a step such as a bend. Even with this, the energy-saving performance can be improved, and the air blowing noise can be reduced. In addition, in the first embodiment, the curvature of the second curved portion 43 on the downstream side of the airflow-direction vane 7 is smaller, and hence the height of the airflow-direction vane 7 can be reduced. Therefore, the airflow resistance can be reduced when the air current passes along the airflow-direction vane 7. Even with this, the pressure loss can be reduced, the energy-saving performance can be improved, and the air blowing noise can be reduced.

Second Embodiment

Figure 4:
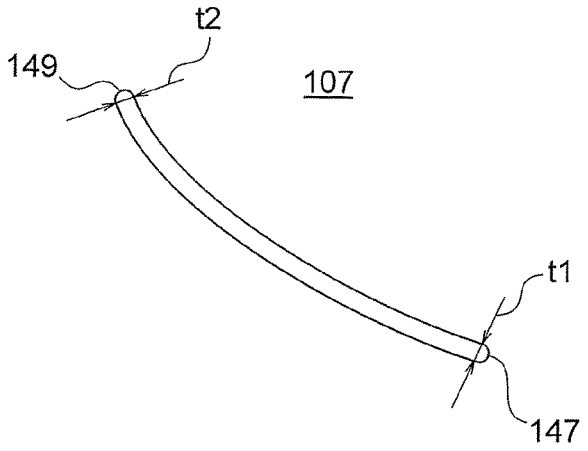
FIG. 4 is a sectional view perpendicular to a longitudinal direction of an airflow-direction vane according to a second embodiment of the present invention.

Next, with reference to FIG. 4, a second embodiment of the present invention is described. FIG. 4 is a sectional view perpendicular to a longitudinal direction of an airflow-direction vane according to the second embodiment of the present invention. Note that, the air conditioner of the second embodiment differs from the above-mentioned first embodiment only in the configuration of the airflow-direction vane to be described below, and other configurations are similar to those in the first embodiment.

An upstream end 149 of an airflow-direction vane 107 of the air conditioner of the second embodiment is formed into a round shape when viewed in a cross section of FIG. 4. Further, regarding the thickness of the airflow-direction vane 107 (thickness in a direction of the radius of the circle forming the curve), a maximum thickness t2 is obtained at the upstream end 149, and a minimum thickness t1 is obtained at a downstream end 147.

Also in the air conditioner according to the second embodiment configured as described above, advantages similar to those in the above-mentioned first embodiment can be obtained. In addition, in the second embodiment, the airflow-direction vane 107 includes the round-shaped upstream end 149. Therefore, the change of the air current can be reduced at the upstream end 149 of the airflow-direction vane 107, and hence the separation of the air current can be prevented. Further, even when the inflow angle IF of the air current changes, the separation of the air current can be prevented across a wide inflow angle IF. Further, the minimum thickness of the airflow-direction vane 107 is obtained at the downstream end 147. Therefore, the wake width can be reduced, and hence the mixing loss to be caused in the wake can be reduced. Even with this, the pressure loss can be reduced, the energy-saving performance can be improved, and the air blowing noise can be reduced.

Third Embodiment

Figure 5:
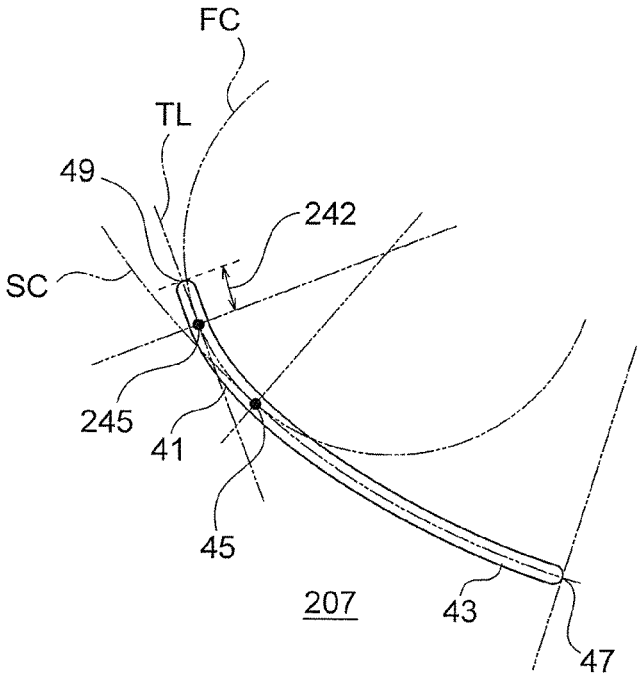
FIG. 5 is a view illustrating a curved mode of an airflow-direction vane according to a third embodiment of the present invention.

Next, with reference to FIG. 5, a third embodiment of the present invention is described. FIG. 5 is a view illustrating a curved mode of an airflow-direction vane according to the third embodiment of the present invention. Note that, the air conditioner of the third embodiment differs from the above-mentioned first and second embodiments only in the configuration of the airflow-direction vane to be described below, and other configurations are similar to those in the first and second embodiments.

An airflow-direction vane 207 of the air conditioner of the third embodiment includes the first curved portion 41, the second curved portion 43, and further a flat plate portion 242. The flat plate portion 242 is positioned further on the upstream side with respect to the first curved portion 41. When viewed in FIG. 5, the flat plate portion 242 is a flat plate-like part extending linearly along the tangent TL of the first circle FC at a boundary portion (inflection point portion) 245 between the first curved portion 41 and the flat plate portion 242. Further, in other words, the airflow-direction vane 207 includes the flat plate portion 242, the first curved portion 41, and the second curved portion 43 in the stated order in a range from the upstream end 49 to the downstream end 47.

Also in the air conditioner according to the third embodiment configured as described above, advantages similar to those in the above-mentioned first embodiment can be obtained. In addition, in the third embodiment, after the air current collides with the upstream end 49 of the vane, the air current does not need to immediately flow along the curved portions of the airflow-direction vane 207. Therefore, the air current obtained immediately after the collision with the upstream end 49 tends to flow while following the airflow-direction vane 207, and thus the separation of the air current can be prevented. Even with this, the pressure loss due to the separation of the air current can be reduced, the energy-saving performance can be improved, and the air blowing noise can be reduced.

Fourth Embodiment

Figure 6:
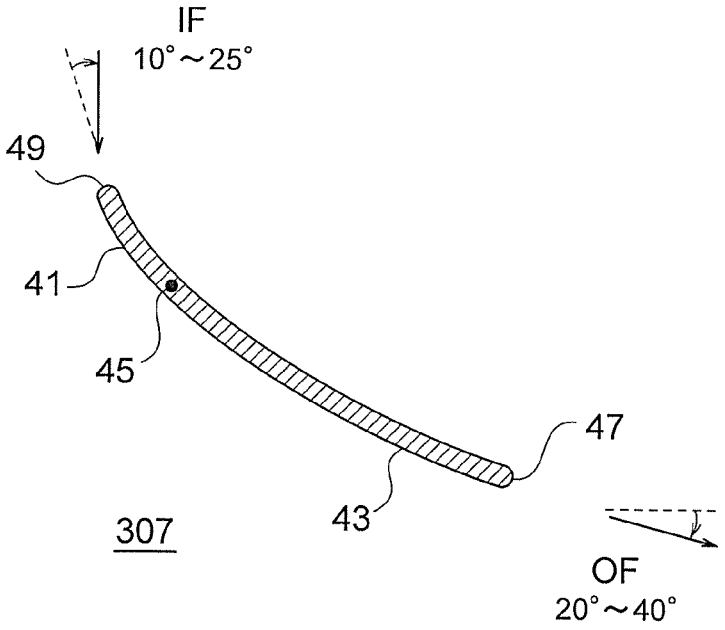
FIG. 6 is a sectional view perpendicular to a longitudinal direction of an airflow-direction vane according to a fourth embodiment of the present invention.

Next, with reference to FIG. 6, a fourth embodiment of the present invention is described. FIG. 6 is a sectional view perpendicular to a longitudinal direction of an airflow-direction vane according to the fourth embodiment of the present invention. Note that, the air conditioner of the fourth embodiment differs from the above-mentioned first to third embodiments only in the configuration of the airflow-direction vane to be described below, and other configurations are similar to those in the first to third embodiments.

An airflow-direction vane 307 of the air conditioner of the fourth embodiment is configured so that the inflow angle IF and the outflow angle OF of the airflow-direction vane 7 in the above-mentioned first embodiment are specifically set to from 10° to 25° and from 20° to 40°, respectively. In other words, the airflow-direction vane 307 is configured so that the inflow angle IF during the horizontal blowing is from 10° to 25°. When the inflow angle IF exceeds 25°, the air current is liable to separate on the convex surface 7*a* side of the airflow-direction vane 307. Further, when the inflow angle IF is less than 10°, the inflow angle IF takes a negative value when the airflow-direction vane 307 is placed in a downward blowing mode, and hence the air current is liable to separate on the concave surface 7*b* side.

Also in the air conditioner according to the fourth embodiment configured as described above, advantages similar to those in the above-mentioned first embodiment can be obtained. In addition, in the fourth embodiment, the inflow angle IF is set to from 10° to 25°, and hence it is possible to obtain an airflow-direction vane structure capable of suppressing separation of the air current on the convex surface 7*a* side during the horizontal blowing and separation of the air current on the concave surface 7*b* side during the downward blowing.

Fifth Embodiment

Figure 7:
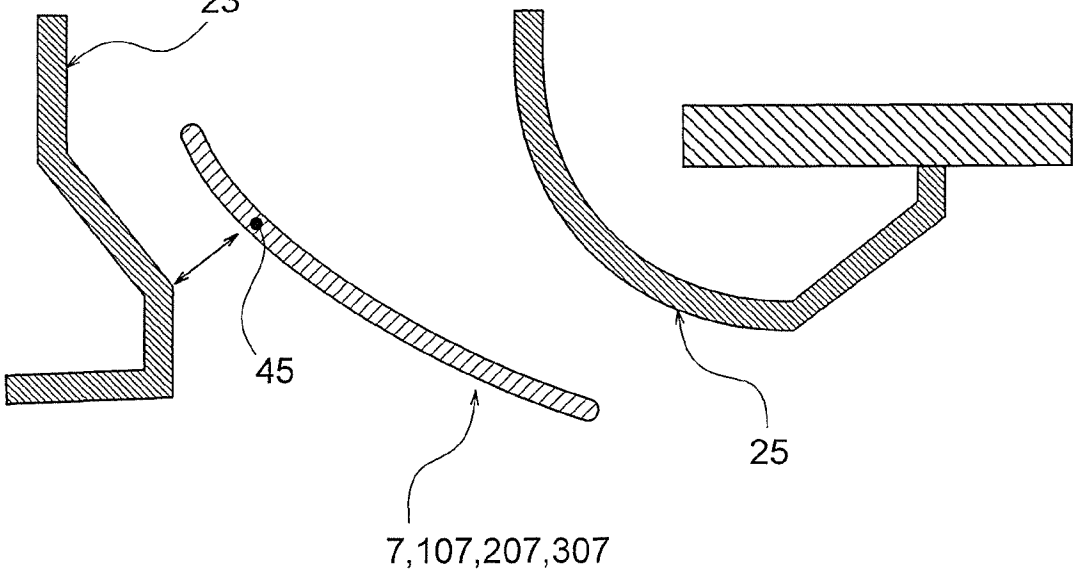
FIG. 7 is a view illustrating a peripheral portion of an airflow-direction vane in a horizontal blowing state in a cross section perpendicular to a longitudinal direction of the airflow-direction vane according to a fifth embodiment of the present invention.

Next, with reference to FIG. 7, a fifth embodiment of the present invention is described. FIG. 7 is a view illustrating a peripheral portion of an airflow-direction vane in a horizontal blowing state in a cross section perpendicular to a longitudinal direction of the airflow-direction vane according to a fifth embodiment of the present invention. Note that, the air conditioner of the fifth embodiment is similar to any one of the configurations of the first to fourth embodiments except for the configuration to be described below.

In the air conditioner of the fifth embodiment, the boundary portion 45 of the airflow-direction vane 7, 107, 207, or 307 matches with a closest portion, which is the closest part to the inner air duct wall 23 on the airflow-direction vane in the horizontal blowing state, or the boundary portion 45 is positioned on a downstream side with respect to the closest portion on the airflow-direction vane. Note that, FIG. 7 illustrates, as an example, a mode in which the boundary portion 45 of the airflow-direction vane 7 matches with the above-mentioned closest portion.

Also in the air conditioner according to the fifth embodiment configured as described above, advantages similar to those in the corresponding above-mentioned first to fourth embodiments can be obtained. In addition, in the fifth embodiment, the following advantages are attained. That is, in a region on the upstream side with respect to the position at which the airflow-direction vane is closest to the inner air duct wall 23, the convex surface of the airflow-direction vane forms an air duct together with the inner air duct wall 23. Therefore, even when the curvature of the first curved portion 41 is large, it is possible to prevent separation of the air current on the convex surface 7*a* side of the airflow-direction vane. That is, when the advantages of the above-mentioned first to fourth embodiments are obtained with use of the first curved portion 41 having a large curvature, the first curved portion 41 can be utilized in a mode in which the air current is further less liable to separate on the convex surface 7*a* side.

Sixth Embodiment

Figure 8:
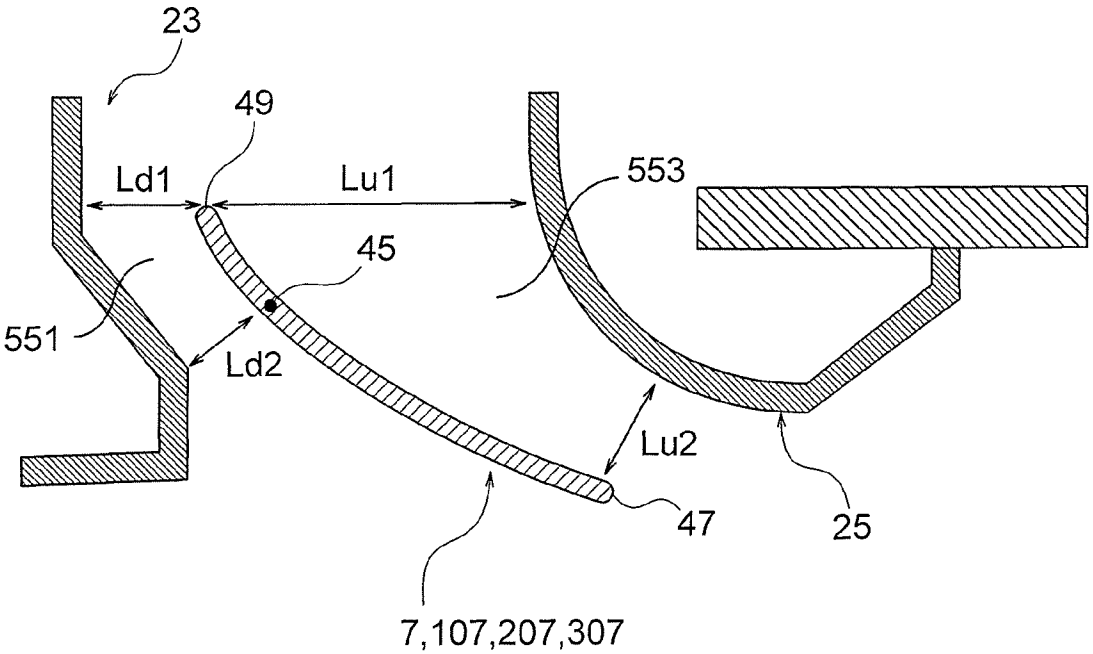
FIG. 8 is a view illustrating a peripheral portion of an airflow-direction vane in a cross section perpendicular to a longitudinal direction of the airflow-direction vane according to a sixth embodiment of the present invention.

Next, with reference to FIG. 8, a sixth embodiment of the present invention is described. FIG. 8 is a view illustrating a peripheral portion of an airflow-direction vane in a cross section perpendicular to a longitudinal direction of the airflow-direction vane according to a sixth embodiment of the present invention. Note that, the air conditioner of the sixth embodiment is similar to any one of the configurations of the first to fifth embodiments except for the configuration to be described below.

In the air conditioner of the sixth embodiment, an inner air duct 551 formed by the inner air duct wall 23 and the airflow-direction vane 7, 107, 207, or 307 during the horizontal blowing and an outer air duct 553 formed by the outer air duct wall 25 and the airflow-direction vane 7, 107, 207, or 307 during the horizontal blowing are both formed into a narrowed shape. That is, a shortest distance Lu1 between the outer air duct wall 25 and the upstream end 49 of the airflow-direction vane is larger than a shortest distance Lu2 between the outer air duct wall 25 and the downstream end 47, and a shortest distance Ld1 between the inner air duct wall 23 and the upstream end 49 is larger than a shortest distance Ld2 from the airflow-direction vane on the downstream side with respect to the upstream end 49 to the inner air duct wall 23. Note that, the shortest distance Ld2 refers to an interval between the airflow-direction vane and the inner air duct wall 23 at a position at which the airflow-direction vane is closest to the inner air duct wall 23, and FIG. 8 illustrates the interval between the boundary portion 45 and the inner air duct wall 23 as an example.

Also in the air conditioner according to the sixth embodiment configured as described above, advantages similar to those in the corresponding above-mentioned first to fifth embodiments can be obtained. In addition, in the sixth embodiment, the following advantages are attained. That is, each of the inner air duct 551 and the outer air duct 553 is formed into a narrowed shape, and hence such advantages can be obtained that the air current easily becomes stable, and the air current is less liable to separate on the airflow-direction vane and on the inner air duct wall 23 or the outer air duct wall 25.

Seventh Embodiment

Figure 9:
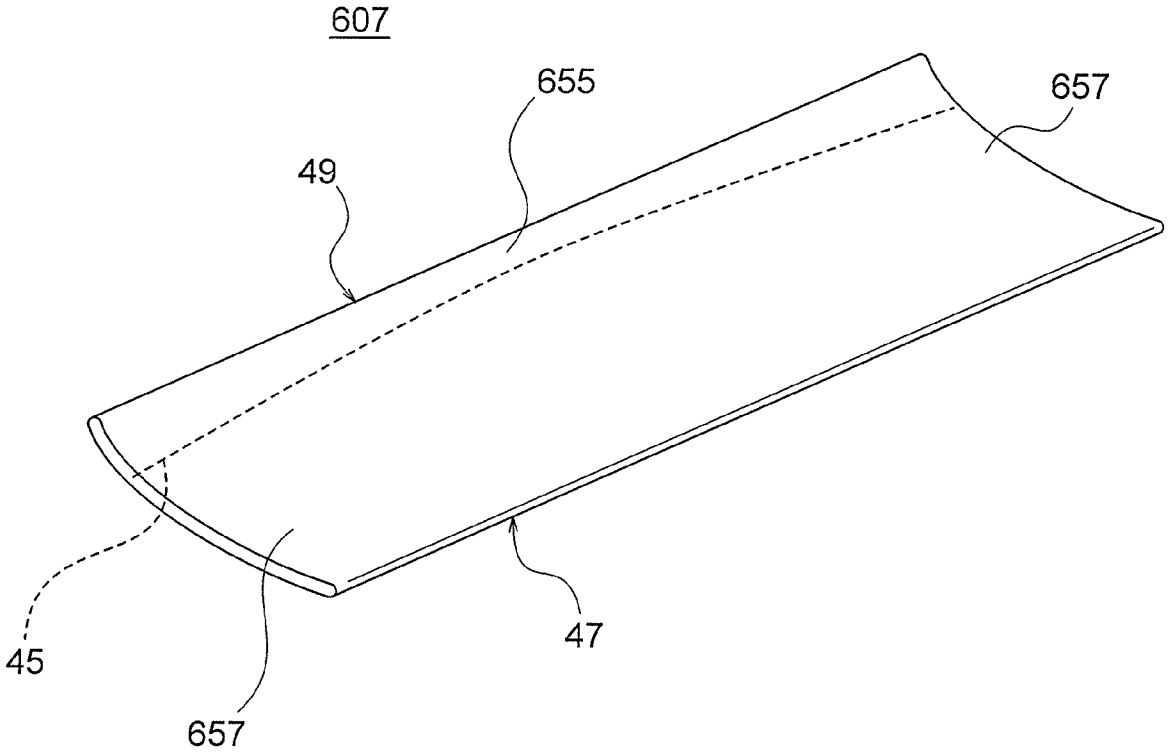
FIG. 9 is a perspective view of an airflow-direction vane according to a seventh embodiment of the present invention.

Next, with reference to FIG. 9, a seventh embodiment of the present invention is described. FIG. 9 is a perspective view of an airflow-direction vane according to a seventh embodiment of the present invention. Note that, the air conditioner of the seventh embodiment is similar to any one of the configurations of the first to sixth embodiments except for the configuration to be described below.

In an airflow-direction vane 607 in the air conditioner of the seventh embodiment, the boundary portion 45 between the first curved portion 41 and the second curved portion 43 changes its position with respect to the downstream end 47 and the upstream end 49 across the vane longitudinal direction (direction in which the upstream end and the downstream end extend). In particular, in the example illustrated in FIG. 9, the boundary portion 45 is gently curved in such a mode that a part of the boundary portion 45 in a longitudinal center region 655 is closer to the upstream end 49 side than parts of the boundary portion 45 in longitudinal both-end regions 657.

Also in the air conditioner according to the seventh embodiment configured as described above, advantages similar to those in the corresponding above-mentioned first to sixth embodiments can be obtained. In addition, in the seventh embodiment, the following advantages are attained. That is, the position of the boundary portion 45 is changed across the longitudinal direction, and hence, even when the air current is separated on the convex surface 7*a* side of the airflow-direction vane 607, the separation occurring position can be shifted in accordance with the longitudinal direction of the airflow-direction vane 607. Therefore, the growth of the vortex generated by the separation can be suppressed, and the separation region can be reduced.

Note that, in the above-mentioned fifth embodiment, when the airflow-direction vane in which the boundary portion changes its position across the vane longitudinal direction is used as in the seventh embodiment, regarding the part of the boundary portion closest to the upstream end side, this part of the boundary portion is placed so as to match with the closest portion, which is the part closest to the inner air duct wall on the airflow-direction vane in the horizontal blowing state, or so as to be positioned on the downstream with respect to the closest portion.

Although the details of the present invention are specifically described above with reference to the preferred embodiments, it is apparent that persons skilled in the art may adopt various modifications based on the basic technical concepts and teachings of the present invention.

For example, the air conditioner of the present invention is not limited to the configuration including four air inlets, and may employ a configuration including only one air inlet or a configuration including an arbitrary number of plurality of air inlets. Further, in the present invention, the number of air outlets to be installed is not limited similarly. Further, when the plurality of air outlets are installed, the airflow-direction vane may be installed in such a mode that the airflow-direction vane is installed for only one of the plurality of air outlets, in such a mode that the airflow-direction vanes are installed for part of the plurality of air outlets, or in such a mode that the airflow-direction vanes are installed for all of the plurality of air outlets. In the above-mentioned embodiments, among the above-mentioned modes, the mode in which the airflow-direction vanes are installed for all of the air outlets has been described as an example.

Further, in the above-mentioned embodiments, the ceiling-concealed air conditioner is described as an example, but the present invention is not limited thereto. The present invention is widely applicable to an apparatus configured to exchange heat between the air inlet and the air outlet. Examples of the apparatus include an indoor unit constructing a refrigeration cycle apparatus, for example, an indoor unit for an air conditioner. Further, the fan for generating the air current from the air inlet to the air outlet is not necessarily limited to be arranged in the flow passage of air from the air inlet to the air outlet.

REFERENCE SIGNS LIST

1 main body, 5 heat exchanger, 7, 107, 207, 307, 607 airflow-direction vane, 17 suction grille (air inlet), 21 panel air outlet (air outlet), 23 inner air duct wall, 25 outer air duct wall, 31 inside of room (target space), 41 first curved portion, 43 second curved portion, 45 boundary portion, 47, 147 downstream end, 49, 149 upstream end, 242 flat plate portion, 551 inner air duct, 553 outer air duct, 655 longitudinal center region, 657 longitudinal both-end region

The invention claimed is:

1. An air conditioner, comprising:

a fan;

a heat exchanger housed inside a main body and arranged in a flow passage of air to be sucked into the main body through an air inlet and blown out to a target space through an air outlet;

wherein the air outlet is located downstream of the fan; and an airflow-direction vane arranged at the air outlet, wherein the airflow-direction vane comprises a first curved portion and a second curved portion, wherein the first curved portion is positioned on an upstream side with respect to the second curved portion, and a curvature of the first curved portion is larger than a curvature of the second curved portion, and wherein the airflow-direction vane further comprises a flat plate portion, and wherein the flat plate portion is positioned on an upstream side with respect to the first curved portion.

2. An air conditioner according to claim 1, wherein a curvature of a whole of the first curved portion is larger than a curvature of a whole of the second curved portion.

* * * * *